United States Patent [19]

Johnson

[11] 4,192,661

[45] Mar. 11, 1980

[54] ADSORBING IMPURITIES FROM CRYOGENIC FLUID MAKE-UP PRIOR TO ADMIXING WITH FEED

[75] Inventor: Robert W. Johnson, Holbrook, Mass.

[73] Assignee: Helix Technology Corporation, Waltham, Mass.

[21] Appl. No.: 911,624

[22] Filed: Jun. 1, 1978

[51] Int. Cl.[2] ..... F25J 3/00

[52] U.S. Cl. ..... 62/12; 62/18; 62/38

[58] Field of Search ..... 62/15, 18, 38, 9

[56] References Cited

U.S. PATENT DOCUMENTS

| | | | |
|---|---|---|---|
| 2,909,903 | 10/1959 | Zimmerman | 62/9 |
| 3,233,418 | 2/1966 | Shaievitz | 62/9 |
| 3,250,079 | 5/1966 | Davis et al. | 62/9 |
| 3,389,565 | 6/1968 | Ergenc | 62/9 |
| 3,992,167 | 11/1976 | Beddome | 62/18 |

*Primary Examiner*—Norman Yudkoff

*Attorney, Agent, or Firm*—David E. Brook

[57] ABSTRACT

A cryogenic apparatus is disclosed herein with an improved flow path for removing impurities introduced by a make-up stream of cryogenic fluid by directing the make-up stream to means to adsorb impurities therein prior to combining the make-up stream with the main feed stream for the cryogenic apparatus.

10 Claims, 2 Drawing Figures

ADSORBING IMPURITIES FROM CRYOGENIC FLUID MAKE-UP PRIOR TO ADMIXING WITH FEED

BACKGROUND OF THE INVENTION

1. Field of the Invention

This invention is in the field of cryogenic and/or refrigeration apparatus.

2. Description of the Prior Art

In a cryogenic apparatus in which cryogenic fluids are cooled to develop refrigeration at cryogenic temperatures, it is necessary to pass the cryogenic fluid through several heat exchange systems of increasingly lower temperatures. For example, in a cryogenic apparatus to liquify helium, it is often necessary to pass gaseous helium through as many as three heat exchangers followed by rapid expansion of the high pressure cold helium gas to liquify it. The temperature involved in such systems can reach values as low as a few tenths of a degree Kelvin. Because of this, it is essential that the helium gas be as free as possible of any gaseous contaminants. The presence of such contaminants would very rapidly plug the heat exchange passages because they freeze out as solids at the low temperatures involved, thus disabling the cryogenic apparatus. Even in closed systems, the helium gas can pick up gaseous contaminants including carbon dioxide, air (and thus, oxygen, nitrogen and argon), hydrogen and water vapor. When helium is withdrawn and replaced with a make-up stream, the amount of impurities in the make-up stream tends to be significantly elevated compared to the amount present in the pure feed stream.

Such gaseous impurities in the cryogenic fluid streams are commonly removed by passing the gas to be purified through a bed of adsorbent, such as a bed of activated charcoal in an adsorber unit. Nevertheless, when make-up streams are involved, it has invariably been the practice to combine the relatively highly contaminated, low-volume make-up stream with the relatively pure, high-volume, pure feed stream prior to passing it through the adsorber unit. Whereas this method does reduce the contaminants in the combined fluid stream, it is an inefficient removal process and it does not reduce the levels of contaminant to levels which are acceptable in many applications.

SUMMARY OF THE INVENTION

This invention relates to cryogenic apparatus in which a feed stream of a cryogenic fluid is combined with a make-up stream of cryogenic fluid to form a combined stream which is cooled to provide refrigeration. In the improved apparatus, means for directing the make-up stream, which contains an elevated level of one or more contaminants with respect to the feed stream, is directed to adsorber means for reducing the level of the contaminants prior to directing it to a mixing means for combining the feed and make-up streams. Thereafter, means for cooling are employed to cool the combined stream, which has a significantly reduced level of contaminants, so that when it is cooled below its freezing point, there is not a serious problem caused by the freeze out of contaminants.

Directing the make-up stream through an adsorber means prior to mixing it with the relatively pure feed stream can be done simply and inexpensively in most cryogenic apparatus. Nevertheless, the resulting reduction of the level of contaminants which can be obtained compared to mixing the streams prior to the adsorber means is dramatic.

DESCRIPTION OF PREFERRED EMBODIMENTS

This invention can be further described in specific detail with reference to the Figures. Although the Figures illustrate a helium liquefaction apparatus in which the helium gas streams contain neon as a contaminant, it should be understood that the principles of this invention are generally applicable to other systems which involve cooling a combined stream of cryogenic fluid formed from a make-up and feed stream as well as other contaminants besides neon.

Figure 1:
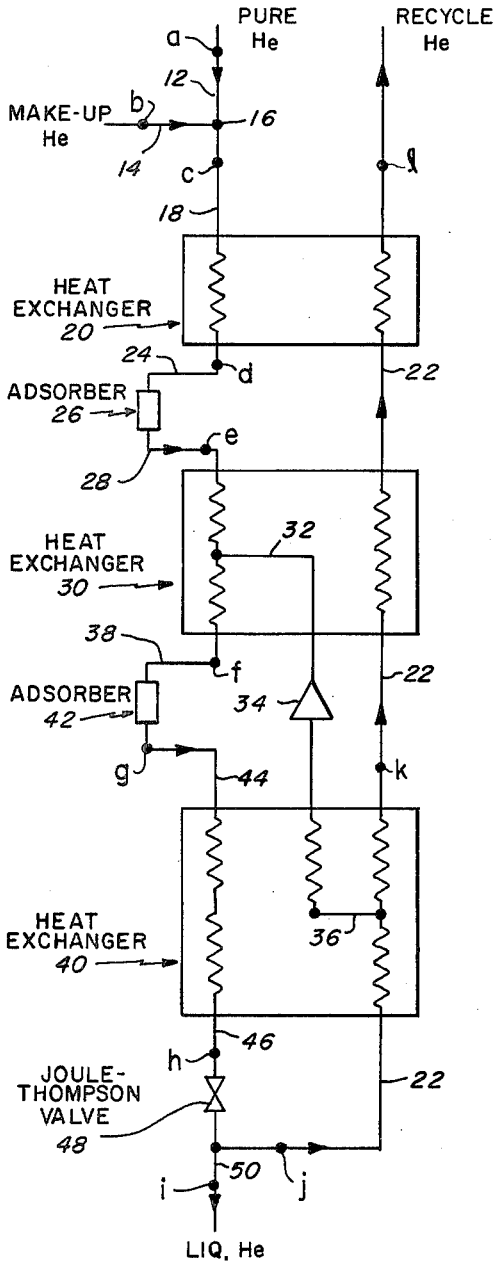
FIG. 1 is a diagrammatic illustration of the fluid flow in a typical helium liquifier of the prior art; and, FIG. 2 is a diagrammatic illustration of the fluid flow in an improved helium liquifier according to the principles of this invention.

In FIG. 1, high-pressure warm incoming helium gas forms a feed stream of cryogenic fluid in feed line 12. Make-up helium at room temperature is introduced through make-up line 14 which joins feed line 12 at mixing tee 16. The combined stream of helium is directed by line 18 to a countercurrent heat exchanger 20. Suitable heat exchangers might be formed from finned tubing wound in an annular passage, the passage within the tubing carrying the high pressure combined helium feed stream and a channel around the fins carrying low-pressure helium introduced into exchanger 20 through low pressure exit line 22. Thus, colder helium gas in exit line 22 serves to cool the combined high pressure helium in heat exchanger 20.

In a typical apparatus of the prior art, the partially cooled combined helium stream is directed by line 24 into first adsorber 26 to remove contaminants. Typically, adsorber 26 might contain charcoal adsorbent and be maintained at a temperature of 80° K., which is suitable for adsorbtion of oxygen present in the combined helium inlet stream. The outlet of adsorber 26 is directed by line 28 to heat exchanger 30 wherein it is further cooled in countercurrent flow with low pressure helium in outlet 22. As shown, it is also customary to divert a portion of the partially cooled inlet helium through line 32, expand it in expander 34 which further cools it, and to use this portion in heat exchanger 40 to supplement the cooling in heat exchanger 40. This portion of the incoming helium is then recirculated in the system by flow line 36 which combines this portion of helium with that in the exit line 22.

In order to remove neon contaminant, the cooled inlet helium stream is directed from heat exchanger 30 by flow line 38 to a second charcoal adsorber 42 which is typically maintained at a temperature of about 40° K. Exiting helium is then directed by line 44 to final heat exchanger 40 where it is cooled to a temperature near its liquefaction temperature. High pressure cooled helium exiting from heat exchanger 40 is directed by flow line 46 into a Joule-Thompson valve 48 where it is expanded and partially liquified. The liquid portion is then removed via product line 50. A portion of the helium gas not liquified is returned through line 22, as previously explained, and is used to cool incoming helium gas in heat exchangers 20, 30 and 40.

Figure 2:
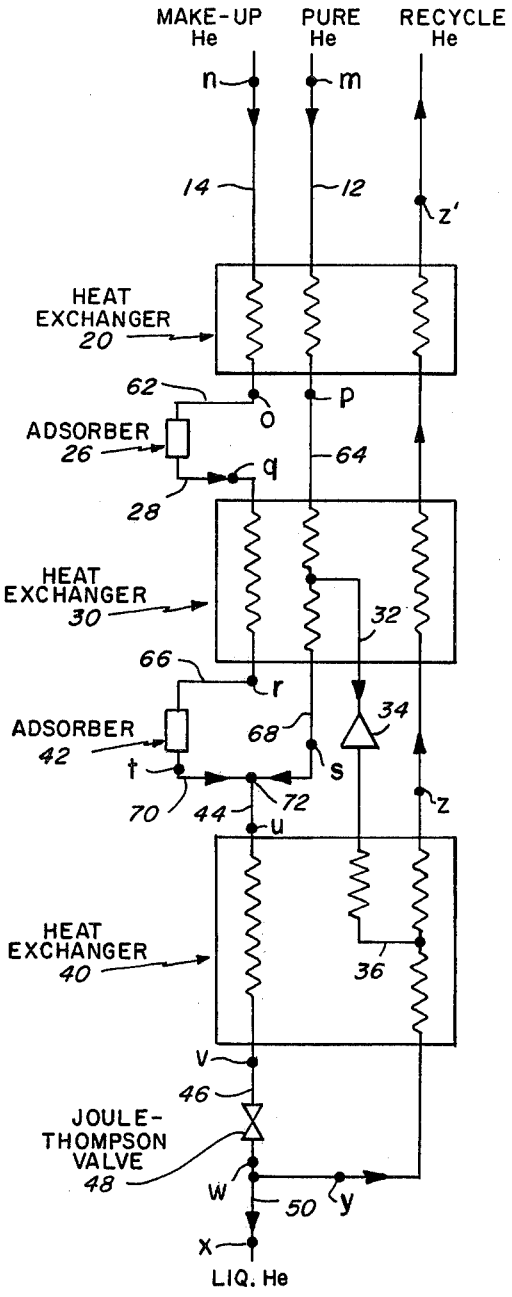

FIG. 2 illustrates a helium liquefaction apparatus similar to that illustrated in FIG. 1 except that it has been improved by directing the make-up stream of helium through a neon adsorber prior to combining it with the feed stream. In FIG. 2, elements similar to those in FIG. 1 have been given similar numerals for purposes of clarity.

Thus, pure helium feed contained in feed line 12 as well as make-up helium in line 14 are maintained separately through heat exchanger 20. Make-up helium exiting from heat exchanger 20 is directed by flow line 62 to adsorber 26 and by flow line 28 to heat exchanger 30. Pure helium is directed in a separate flow line 64 into and through heat exchanger 30.

After exiting from heat exchanger 30, the make-up helium flows in line 66 to second adsorber 42 wherein a significant reduction in the level of neon contaminant is obtained. Pure feed helium exits from heat exchanger 30 in flow line 68 and is combined with make-up helium exiting from second adsorber 42 in flow line 70 at mixing tee 72. Thereafter, the combined helium stream enters heat exchanger 40 via flow line 44 and is directed to Joule-Thompson valve 48 by flow line 46. Liquified product helium is withdrawn through product line 50 whereas gaseous helium is recycled through return line 22 as in the apparatus of FIG. 1.

Typical cycle parameters are given in Table 1 both for the apparatus of FIG. 1 and the apparatus of FIG. 2 based upon a feed stream of 176.6 grams per second of pure helium and a make-up stream of 17.6 grams per second of helium containing 70 parts per million neon. From the data given in Table 1, it can be seen that a simple change in the flow path of the make-up helium results in a dramatic increase in the efficiency of the neon adsorber. The same adsorber removes 98.6% of the contaminant instead of 84.3% and the level of neon contamination after the adsorbers is reduced to approximately one-tenth of its previous value.

1. A cryogenic apparatus, comprising, in combination:
   a. a feed stream of cryogenic fluid to be cooled in said apparatus;
   b. a make-up stream of cryogenic fluid containing an elevated level of at least one contaminant with respect to said feed stream;
   c. mixing means for combining the feed and make-up streams into a combined stream of cryogenic fluid;
   d. means for passing said combined stream of cryogenic fluid through a heat exchanger wherein it is cooled to a temperature below the freezing point of said contaminant;
   e. adsorber means for reducing the level of said contaminant; and,
   f. means for directing said make-up stream through the adsorber means prior to directing it to said mixing means.

2. A cryogenic apparatus of claim 2 wherein said feed stream and said make-up stream comprise feed and make-up streams of gaseous helium, respectively.

3. A cryogenic apparatus of claim 2 additionally including means to liquify gaseous helium.

4. A cryogenic apparatus of claim 3 additionally including means for withdrawing liquified helium.

5. A cryogenic apparatus of claim 4 wherein said adsorber means comprises a charcoal adsorber.

6. A cryogenic apparatus of claim 5 wherein said means for liquifying helium comprises means to expand high pressure gaseous helium to liquify it.

7. A cryogenic apparatus of claim 6 wherein said means for expanding comprises a Joule-Thompson valve.

8. A cryogenic apparatus of claim 6 wherein said means for expanding comprises an expander.

9. In a refrigeration cycle wherein a feed stream of a gaseous fluid is cooled to a cryogenic temperature to liquify said fluid, liquified fluid is withdrawn from said cycle, an externally added make-up stream of gaseous fluid having an elevated level of at least one contaminant with respect to the level in said feed stream is combined with said feed stream to replace withdrawn liquified fluid, and said combined stream is cooled to a temperature below the freezing point of said contaminant:

The improvement of passing said externally added make-up stream through an adsorber containing an adsorbent for said contaminant prior to combining said externally added make-up stream with said

TABLE 1

| FIG. 1 | | | | | FIG. 2 | | | | |
|---|---|---|---|---|---|---|---|---|---|
| Point | He Flow Rate (g/sec) | Neon (ppm) | Pressure (atm) | Temperature (°K.) | Point | He Flow Rate (g/sec) | Neon (ppm) | Pressure (atm) | Temperature (°K.) |
| a | 176.6 | <1 | 18 | 300 | m | 176.6 | <1(.091) | 18 | 300 |
| b | 17.6 | 70 | 18 | 300 | n | 17.6 | 70 | 18 | 300 |
| c | 176.6 | 6.35 | 18 | 300 | o | 17.6 | 70 | 18 | 80 |
| d | 176.6 | 6.35 | 18 | 80 | p | 176.6 | <1(.091) | 18 | 80 |
| e | 176.6 | 6.35 | 17.5 | 80 | q | 17.6 | 70 | 18 | 80 |
| f | 88 | 6.35 | 17 | 20 | r | 17.6 | 70 | 18 | 20 |
| g | 88 | 1 | 17 | 20 | s | 70.4 | <1(.091) | 18 | 20 |
| h | 88 | 1 | 17 | 5.7 | t | 17.6 | 1 | 18 | 20 |
| i | 17.6 | <1 | 1.2 | 4.6 | u | 88 | .091 | 18 | 20 |
| j | 70.4 | <1 | 1.2 | 4.6 | v | 88 | .091 | 18 | 5.7 |
| k | 159.0 | <1 | 1.2 | 19.0 | w | 88 | .091 | 1.2 | 4.6 |
| l | 159.0 | <1 | 1.2 | 290 | x | 17.6 | .091 | 1.2 | 4.6 |
| | | | | | y | 70.4 | .091 | 1.2 | 4.6 |
| | | | | | z | 159.0 | .091 | 1.2 | 19.0 |
| | | | | | z' | 159.0 | .091 | 1.2 | 290 |

Those skilled in the art will recognize, of course, many equivalents in the specific embodiments described herein. For example, although the invention has been specifically described in terms of helium gas, other cryogenic fluids could also be used including hydrogen, nitrogen, carbon monoxide, oxygen, carbon dioxide, and many others. In addition, contaminants other than neon are clearly removable by the same improved apparatus. Such equivalents are intended to be covered by the following claims.

What I claim is:

feed stream whereby the level of said contaminant is significantly reduced in said combined stream of cryogenic fluid and thereafter passing said combined stream through a heat exchanger wherein it is cooled to a temperature below the freezing point of said contaminant.

10. The improvement of claim 9 wherein said gaseous fluid comprises helium.

* * * * *